US006318213B1

(12) United States Patent
Hendrix et al.

(10) Patent No.: US 6,318,213 B1
(45) Date of Patent: Nov. 20, 2001

(54) ROOFERS SHINGLE REMOVAL TOOL

(76) Inventors: Ralph Dann Hendrix, 94 Hampstead Ct., Severna Park, MD (US) 21146; Stephen Colehouse, 1207 Sunrise Beach Rd., Crownsville, MD (US) 21032

( * ) Notice: Subject to any disclaimer, the term of this patent is extended or adjusted under 35 U.S.C. 154(b) by 0 days.

(21) Appl. No.: 09/478,887

(22) Filed: Jan. 7, 2000

(51) Int. Cl.[7] ..... E04D 15/00
(52) U.S. Cl. ..... 81/45; 254/131.5; 30/169
(58) Field of Search ..... 81/45; 254/131.5; 30/169, 170, 49; 294/57; 299/37

(56) References Cited

U.S. PATENT DOCUMENTS

| | | | | |
|---|---|---|---|---|
| 3,436,111 | * | 4/1969 | England | 294/49 |
| 4,086,699 | * | 5/1978 | Olkkola | 254/131.5 X |
| 4,203,210 | * | 5/1980 | Hadlick | 254/131.5 X |
| 4,477,972 | * | 10/1984 | Testa | 254/131.5 X |
| 4,809,436 | * | 3/1989 | Crookston | 254/131.5 X |
| 4,865,372 | * | 9/1989 | Gabriel | 294/49 |
| 5,010,791 | * | 4/1991 | Williams | 81/45 |
| 5,159,859 | * | 11/1992 | Whitsell | 81/45 |
| 5,813,295 | * | 9/1998 | Jensen | 84/45 |
| 5,893,304 | * | 4/1999 | Carroll | 81/45 |
| 6,070,498 | * | 6/2000 | Mislich et al. | 81/45 |
| 6,098,292 | * | 8/2000 | Harpell | 294/49 |
| 6,105,469 | * | 8/2000 | Gracy | 81/45 |
| 6,113,074 | * | 9/2000 | Foley | 254/131.5 X |

* cited by examiner

*Primary Examiner*—James G. Smith

(57) ABSTRACT

A tool primarily for use in stripping asphalt and wood shingles from a roof consisting of a blade, a body, and a handle. The blade has a wide forward portion with front serrate edge, transverse bends for rigidity, and primary fulcrum. The novel and unique front edge is curved to accommodate sags in the underlying roof and to facilitate insertion under shingles. The body is attached firmly to the blade and contains an upper portion to receive an elongated handle and an undercarriage curved in the vertical longitudinal plane providing a variable mechanical force ratio as the operator uses the tool to remove the roof shingles by vertical travel of the handle. For shingle removal, the front edge of the blade is slid or pushed under shingles and the handle lowered toward the roof surface. The prying action of the blade uses the primary fulcrum to provide optimal mechanical advantage during the initial travel of the elongated handle to break the grip of roofing nails or staples encountered by the leading serrate edge and, as downward motion of the handle continues, smoothly transition to the innovative secondary, variable fulcrum to complete nail or staple removal.

5 Claims, 3 Drawing Sheets

15
10
8
11
29
28
14
10
7
27
17
27
26
26
I 28
29
11
8
14
7
6
5
4
3
2
1
16

FIG. 5a
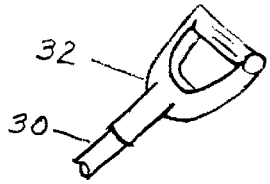
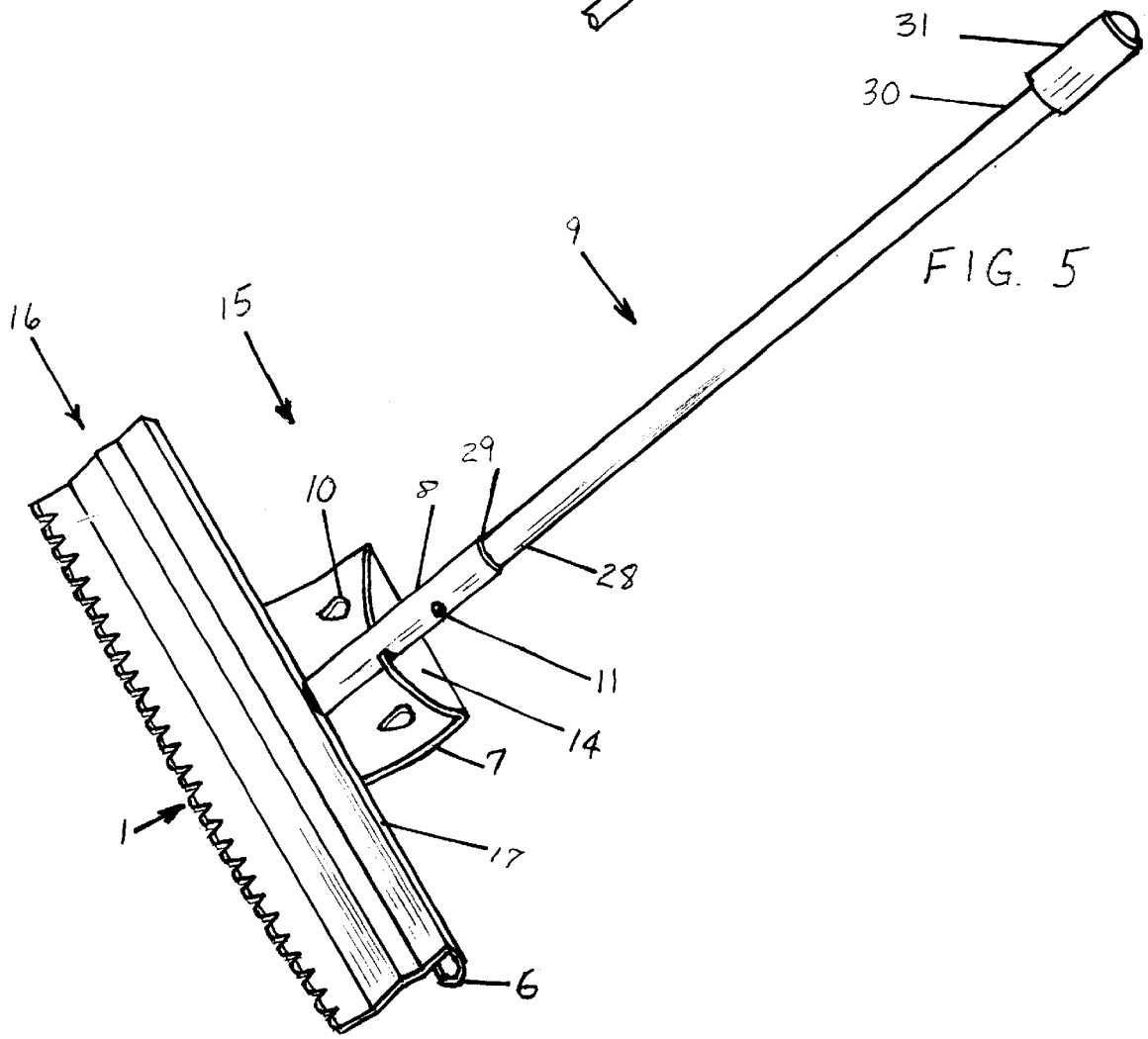
FIG. 5

ROOFERS SHINGLE REMOVAL TOOL

FIELD OF THE INVENTION

This invention relates to hand tools and more specifically to a hand tool used for removal of roofing shingles and nails from a roof.

BACKGROUND OF THE INVENTION

Roofing material for many contemporary single family and multiple family dwelling structures utilizes an outer roof covering consisting of asphalt impregnated fibrous panels or other materials that must be removed and replaced during the useful life of the building or structure to ensure continued protection from weather. Various tools have heretofore been provided for removing old shingles preparatory to the installation of new roofing paper and shingles. Some shingle removing tools include generally planar, narrow heads that remove shingles, many times breaking the shingles into small pieces difficult and labor intensive to gather and remove. Additionally, the designs heretofore provided generally either do not provide sufficient mechanical advantage for ease in removal of nails in plank roofing or double-layer roofing or are of a design such that they are not efficient for rapid removal. For plywood sheathing roof construction used on the majority of single family and multiple family dwellings in the United States, a more efficient tool is needed to speed the removal of shingles. Difficulty inserting tools under a roof with sag between rafters is also a problem that has not heretofore been addressed.

Various tools related to this invention have been used in the past. Examples of prior patents are as follows:

1. U.S. Pat. No. 3,436,111 issued to England on Apr. 1, 1969 discloses a shoveling device.
2. U.S. Pat. No. 4,086,699 issued to Olkkola on May 2, 1978 discloses a roof shingle remover having square-tipped teeth.
3. U.S. Pat. No. 4,477,972 issued to Testa on Oct. 23, 1984 discloses a shingle remover having a flat base-plate.
4. U.S. Pat. No. 4,865,372 issued to Gabriel on Sep. 12, 1989 discloses a shovel-like apparatus with varying embodiments.
5. U.S. Pat. No. 4,809,436 issued to Crookston on Mar. 7, 1989 discloses a roofer's tool with a removable blade.
6. U.S. Pat. No. 6,070,498 issued to Mislich et. al. on Jun. 6, 2000 discloses a tool for removing shingles utilizing forward tines and trailing serrate teeth.
7. U.S. Pat. No. 6,105,469 issued to Gracy on Aug. 22, 2000 discloses a hand tool for removal of material.
8. U.S. Pat. No. 5,893,304 issued to Carroll on Apr. 13, 1999 discloses a roofing removal tool with forward tines and trailing serrate teeth.

The important and novel features of this invention, specifically a curved front edge and combination of primary and variable secondary fulcrums whose functionality are discussed below, are neither disclosed nor suggested in the listed patents.

SUMMARY OF THE INVENTION

This invention, although useful for all types of roofing removal, is specifically designed and especially useful on single layer shingles over plywood attached with nails or staples. A common problem with all of the prior art devices is that they do not accommodate sags in the roof surface. Accordingly, the sweeping curvature of the front edge of this invention can match the sag of plywood roofing by lifting of the handle, thereby easing the insertion under shingles where other devices utilize a straight front edge that will snag a roof surface or shingle edge where such sags exist. This feature of the invention allows the center of the blade to enter beneath the shingles and gradually lift the encountered edge of the shingles from the center outward even in the case of sags. The broad width of the blade increases the shingle removal per movement, the increased mechanical force ratio breaks nails loose easily, and the graduated curvature of the secondary fulcrum keeps the required force nearly constant as the nails are released. In combination, these features reduce the work per area significantly. Shingle removal, due to the unique and claimed features of this removal tool is faster than removal with any known existing tools. In response to this need, this patent provides a shingle removal tool which will enable an operator to remove roofing shingles in a more efficient, less tiring manner with considerable labor cost savings.

The blade width is nominally less than the spacing between roof rafters (in most instances 24 inches) but the blade width can also be narrower (down to 8 inches in width) such that it is slightly greater than the width of the undercarriage for roof-peak and roof covering that is exceptionally difficult to remove. Optionally, the blade can be significantly wider than the preferred embodiment (up to 36 inches) for extremely fast roofing removal under ideal conditions. Also, the greatly increased blade width means fewer operator repetitions for a given area. When removing shingles, the front edge on the wide or "hammerhead" portion of the blade captures the nails or fasteners in the serrate notches designed for that purpose. The trailing portion of the blade base provides a primary fulcrum with great leverage to break nails loose and begin their extraction. As the nails begin to lift the vertical travel of the handle rotates the fulcrum to the undercarriage, curved portion of the body and begins to operate with gradually reduced leverage. This feature reduces the downward travel required of the handle for full nail extraction while providing the optimal leverage at each stage. Serrate notches on the front edge of the blade capture nails or fasteners across the entire width of the blade. The base of the notches form a rounded V to reduce the bending or peeling of nail-heads before the nails are fully removed and to avoid the occurrence of nails becoming snagged in a sharper notch. Transverse ridges and bends across the width of the blade provide the rigidity and strength required for the wide working area. The handle provides the required height for comfortable operation without back-breaking exertion. Other objectives, novel features, and advantages of this patent are provided in the following description of a preferred embodiment and in the appended claims.

OBJECTS AND ADVANTAGES OF THE INVENTION

Objects and advantages of the invention are to provide a shingle removing tool designed and constructed in such a way that:

a) it can be easily inserted underneath roofing shingles in the presence of non-planar variations in the roof surface, b) it is capable of dispersing downward force over a significant area, addressed by the wider primary fulcrum, thereby reducing damage to the roof itself, c) a variable secondary fulcrum in combination with the primary fulcrum provides nail and staple removal with advantages of both high initial mechanical force ratio and limited vertical handle motion, and d) a decrease in both time and subsequent cost of labor are realized in removing the roofing material and effecting the disposal of the debris.

BRIEF DESCRIPTION OF THE DRAWINGS

FIG. 5 is a full perspective view of the Roofer's Shingle Removal Tool.

FIG. 5*a* is a sectional view of the tool handle for an alternate embodiment with a D-shaped handle grip.

THE PREFERRED EMBODIMENT OF THE INVENTION

Figure 1:
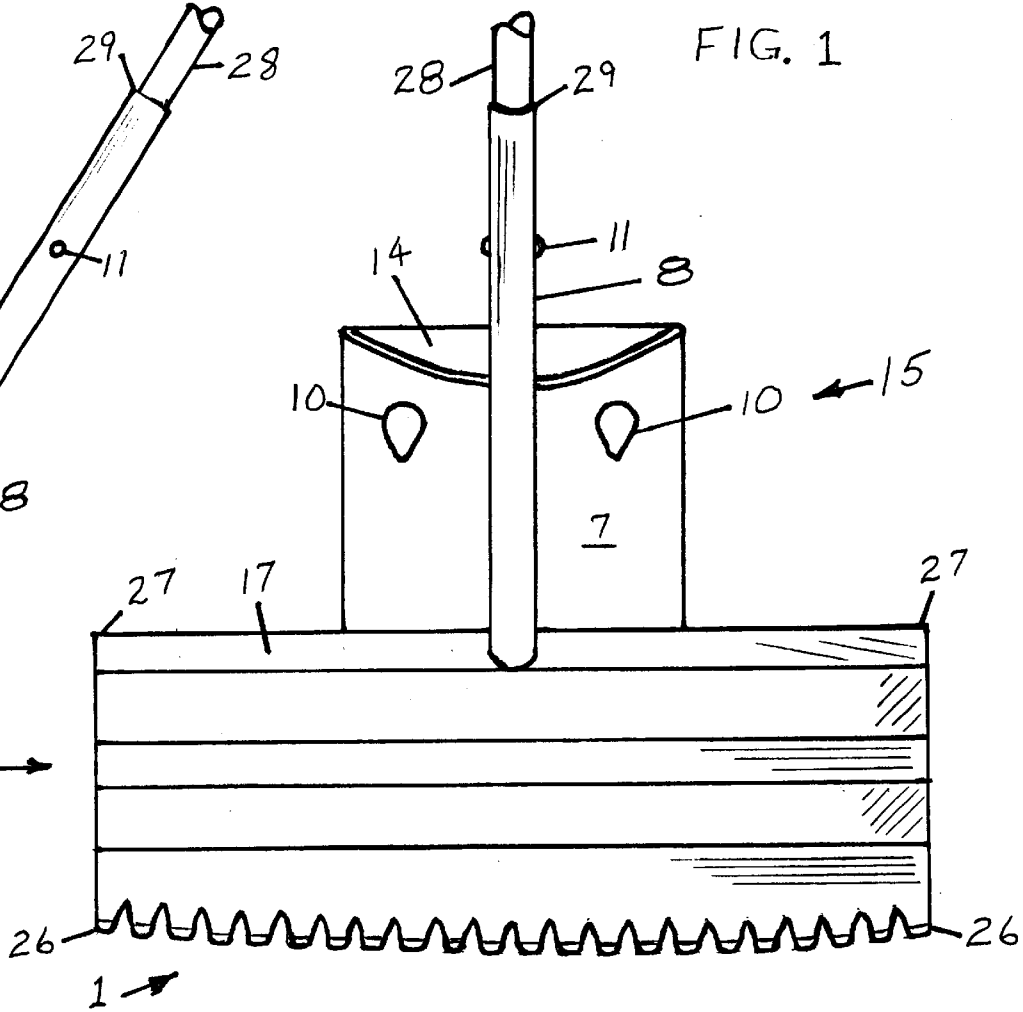
FIG. 1 is a top plan view of the Roofer's Shingle Removal Tool with a portion of the handle not shown.
Figure 2:
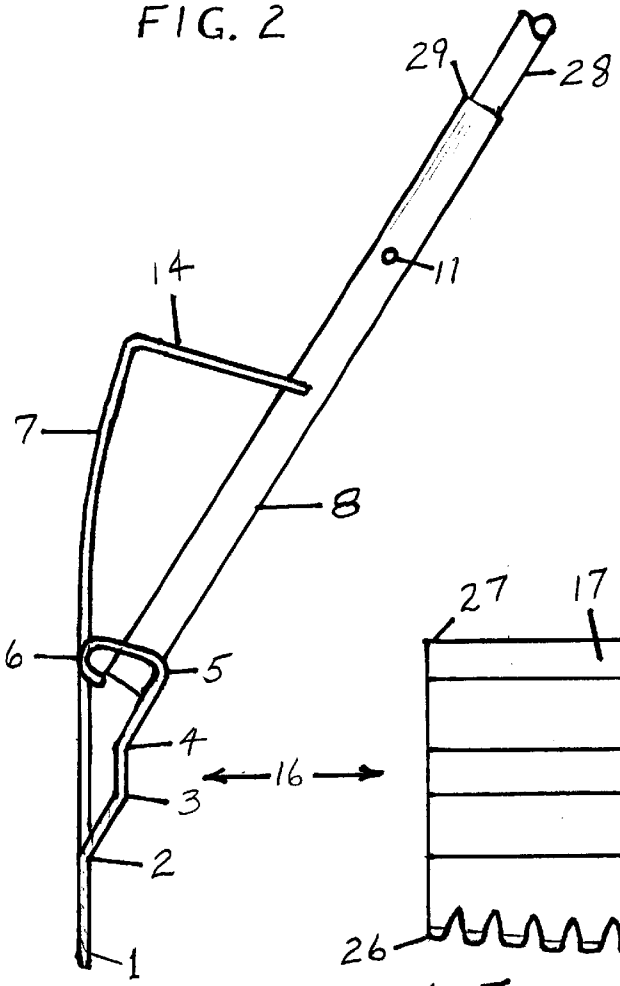
FIG. 2 is a side view of the Roofer's Shingle Removal Tool with a portion of the handle not shown.
Figure 4:
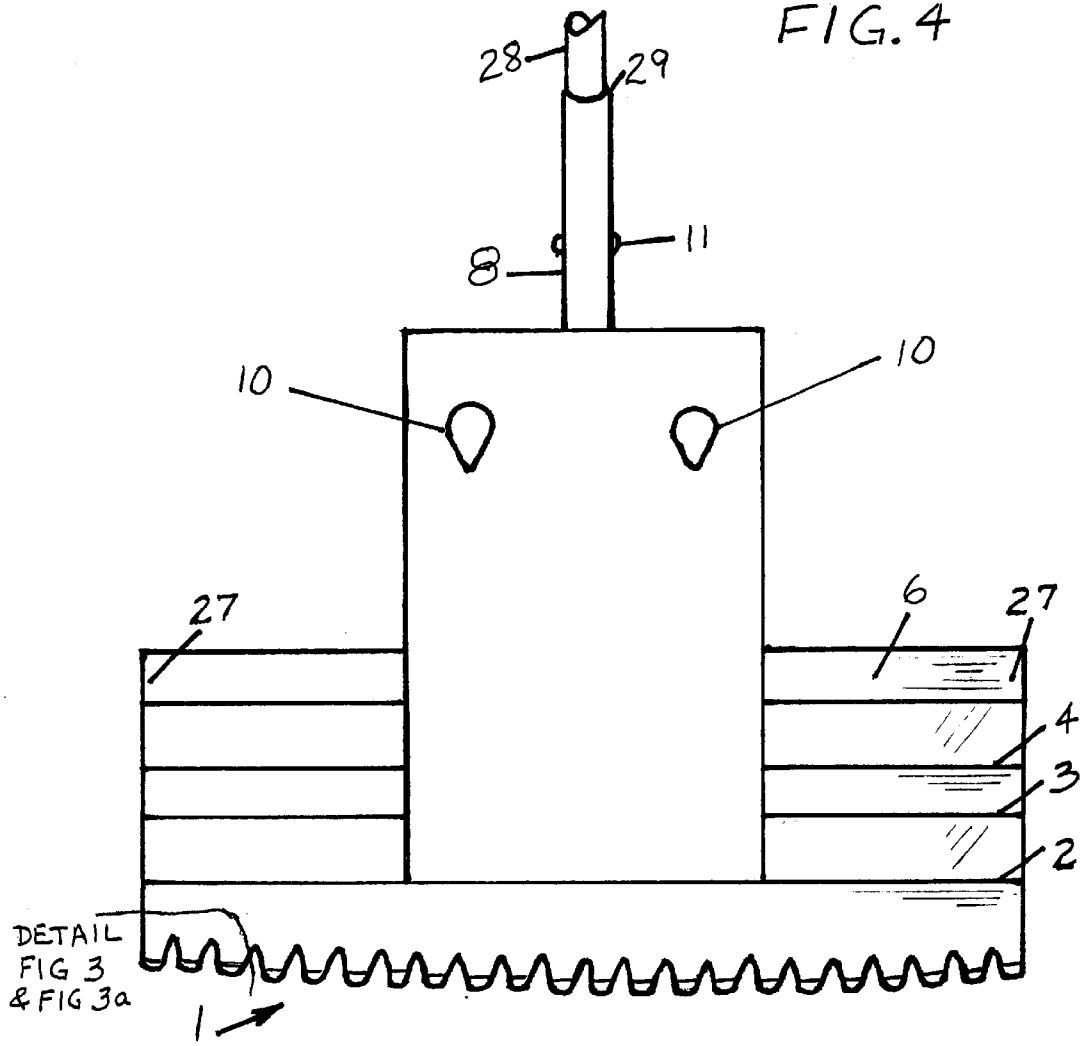
FIG. 4 is a bottom view of the Roofer's Shingle Removal Tool with a portion of the handle not shown.
Figure 3:
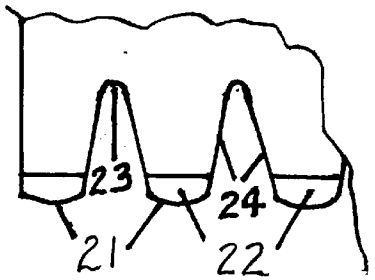
FIG. 3 is a sectional view of the detail top plan for the serrate teeth and notches located along the blade's front edge.
Figure 3A:
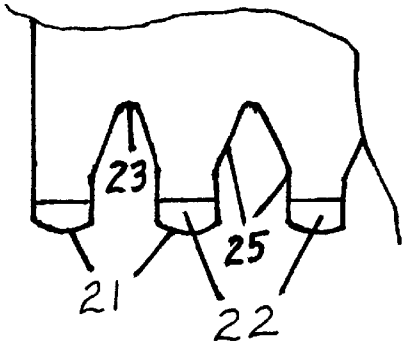
FIG. 3*a* is a sectional view of the detail top plan for an alternate embodiment of the serrate teeth and notches located along the blade's front edge.

The Shingle Removal Tool of this invention comprises a body 15, an elongated handle 9, and a blade 16. The blade width in the preferred embodiment (20 to 22 inches) is marginally less than the spacing between roof rafters. The blade 16 has a novel and unique curved front edge 1 with a radius of curvature (preferred embodiment—radius about 150 inches) which provides several unique benefits. The first benefit is in guiding the front edge 1 under the shingle layer to provide access to the nails or fasteners without catching the outer tips of the blade on the encountered edge of shingles. The problem inserting other narrower tools under shingles may not be severe under ideal conditions, however the curvature of the front edge becomes increasingly important and advantageous as blade width is increased and as variations in the roof surface are encountered. This curve in the front edge accommodates the sag present in most plywood material between roof rafters or trusses. Lifting the handle a few inches allows the front edge 1 to conform to the curvature of the sag in the roof making insertion under shingles much easier. The front edge 1 is enhanced with serrate notches as shown in FIG. 3 or FIG. 3*a* sectional detail views to ease nail and staple capture. The serrate notches shown in FIG. 3*a* (preferred embodiment) remain at constant width for approximately one-third to one-half their depth 25 and then narrow down to a rounded base 23 (radius approx 1/16 inch). This shape opening optimally balances tooth width for longer useful wear life and capture of nails to minimize the bending of nail heads during the shingle removal. Tooth surfaces are also tapered in thickness from the upper 22 and lower 21 surfaces to provide less material thickness at the front edge as an additional means to ease insertion under shingles. The rounded base of the serrate notches results in fewer nails becoming lodged in the tool. The tool in alternate embodiments will have a narrower blade (8–18 inches in width) for difficult removal such as roof-peaks or a wider blade (24–36 inches in width) for rapid removal under ideal circumstances such as thin-staple applications.

Lowering the elongated handle 9 rotates the blade about the primary fulcrum point 6 providing an improved mechanical advantage for breaking nails and fasteners free from the roofing plywood or planking. Once the nails or fasteners begin to be extracted and the front blade edge 1 begins to lift, the fulcrum moves to the secondary variable fulcrum 7 providing gradually reduced mechanical advantage as the nails or fasteners are fully extracted. This gives the extraction power required for even the most demanding applications while keeping the vertical travel of the handle comfortable for the operator. The supporting member 14 reinforces the variable fulcrum 7 and the handle tube 8.

Raised corrugations or bends in the blade 2, 3, and 4 provide transverse stiffening of the blade in conjunction with the trailing edge bend 5 and primary fulcrum 6. This improves the operation when a nail or fastener is contacted only at one extreme end of the blade 26 to reduce bending and springing of the blade as extraction begins. The primary fulcrum 6 across the entire width of the blade reduces lifting of the opposite end of the blade and subsequent torque applied to the handle under the same condition.

The primary fulcrum 6 provides the initial mechanical advantage (12–15 times the downward force). The variable fulcrum 7 (preferred embodiment—non-constant radius of curvature) provides a gradual decrease in operating mechanical advantage as the handle is depressed. The curvature of the secondary fulcrum results in an almost constant downward force required for operation which is less tiring for the operator than repeated jerky operations as experienced with current tools.

The upper portion of the body 8 is a tube connected firmly to the blade 16 and to the undercarriage supporting member 14 and has an opening to receive and firmly hold the elongated handle 9. Teardrop s holes 10 in the undercarriage 7 provide bent nail removal when the tool is pulled toward the operator and provide a convenient means of hanging the tool.

The lower portion of the elongated handle passes through the opening in the rear facing tube 29 and through the tube 8 which provides a strong means to transfer force to the body 15 and blade 16 when the handle is lowered. The lower portion of the handle 28 is fastened securely to the body 15 by fastener 11. The upper end of the handle 30 is covered by a rubber or foam sleeve 31. In an alternate embodiment (FIG. 5*a*), the upper and rearward end of the handle is terminated in a conventional D-shaped handle grip 32.

The tool can be used from either below or above shingles to be removed. For removal of shingle roof covering from the lower edge of the shingle upward, the removal tool is placed under the shingles and a downward motion of the handle removes the first set of nails at the peak of the shingle notches. Pushing forward about 5 inches contacts the next set of nails or fasteners releasing the first row of shingle and releasing the lower row of fasteners on the next row of shingle. This method can be necessary to clear near the roof peak for subsequent removal from top (peak) downward or in certain confined spaces. For shingle removal from top down, the removal tool is placed under the top edge of a row of shingles once a small section of shingles or cap row is cleared and shingles can be released from the roof and pushed forward down the roof slope. This is where the unique curvature of the front edge of the blade 1, design of the notches for nail capture 23 and 25, primary fulcrum 6, and variable fulcrum 7 become particularly effective and is the preferred implementation for this tool design. Removal of shingles from side to side is also extremely effective as up to four rows of shingle can be removed at one time without excessive tearing of the removed shingles.

What is claimed is:

1. A roofing shingle removal tool comprising:

a blade, a body and an elongated handle;

said handle fastened to said body;

said body attached to the blade and comprising a curved undercarriage providing a secondary fulcrum, a supporting member secured to the undercarriage and attached to the handle;

said blade comprising a primary fulcrum, a series of transverse bends, and a plurality of serrate notches in a front edge thereof.

2. A roofing shingle removal tool as recited in claim 1 wherein the front edge is slightly tapered at an upper and a lower surface of the blade to provide less material thickness at the front edge as a means to ease insertion under shingles.

3. A roofing shingle removal tool as recited in claim 1 wherein a resilient sleeve is mounted on an upper end of the handle.

4. A roofing shingle removal tool as recited in claim 1 wherein the handle has an uppermost end containing a "D" shaped member.

5. A roofing shingle removal tool as recited in claim 1 wherein the undercarriage contains oval openings for capturing and removing vent nails and for hanging during storage.

* * * * *